US007088348B2

(12) United States Patent
Siddiqui

(10) Patent No.: US 7,088,348 B2
(45) Date of Patent: Aug. 8, 2006

(54) ERGONOMIC POINTING DEVICE

(75) Inventor: Kabir Siddiqui, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 414 days.

(21) Appl. No.: 10/620,239

(22) Filed: Jul. 14, 2003

(65) Prior Publication Data

US 2005/0012713 A1 Jan. 20, 2005

(51) Int. Cl.
*G09G 5/00* (2006.01)

(52) U.S. Cl. ..... 345/184; 345/157

(58) Field of Classification Search ..... 345/156, 345/157, 163–166, 184; 715/856
See application file for complete search history.

(56) References Cited

U.S. PATENT DOCUMENTS

| | | | | |
|---|---|---|---|---|
| 5,164,712 | A * | 11/1992 | Niitsuma | 345/184 |
| 5,473,344 | A | 12/1995 | Bacon et al. | 145/163 |
| 5,557,440 | A | 9/1996 | Hanson et al. | 359/161 |
| 5,912,661 | A | 6/1999 | Siddiqui | 345/166 |
| 5,963,197 | A | 10/1999 | Bacon et al. | 345/163 |
| 6,014,130 | A * | 1/2000 | Yung-Chou | 345/163 |
| 6,031,518 | A | 2/2000 | Adams et al. | 245/156 |
| 6,097,371 | A | 8/2000 | Siddiqui et al. | 345/164 |
| 6,097,964 | A * | 8/2000 | Nuovo et al. | 455/566 |
| 6,188,393 | B1 * | 2/2001 | Shu | 345/184 |
| 6,246,392 | B1 * | 6/2001 | Wu | 345/163 |
| 6,281,881 | B1 | 8/2001 | Siddiqui et al. | 345/164 |
| 6,285,355 | B1 * | 9/2001 | Chang | 345/163 |
| 6,340,966 | B1 * | 1/2002 | Wang et al. | 345/163 |
| 6,353,429 | B1 | 3/2002 | Long | 345/158 |
| 6,380,927 | B1 | 4/2002 | Ostrum et al. | 345/165 |
| 6,411,279 | B1 * | 6/2002 | Tseng et al. | 345/163 |
| 6,429,852 | B1 | 8/2002 | Adams et al. | 345/163 |
| 6,555,768 | B1 * | 4/2003 | Deruginsky et al. | 200/4 |
| 6,556,150 | B1 | 4/2003 | McLoone et al. | 341/120 |
| 6,571,086 | B1 * | 5/2003 | Uusimaki | 379/368 |
| 6,697,050 | B1 * | 2/2004 | Shinohe et al. | 345/163 |
| 6,813,509 | B1 * | 11/2004 | Aquilar et al. | 455/550.1 |
| 6,862,459 | B1 * | 3/2005 | Sawada et al. | 455/550.1 |
| 6,930,259 | B1 * | 8/2005 | Jorgensen et al. | 200/4 |

OTHER PUBLICATIONS

Richard Pekelney and Robin Chu; *Design Criteria of an Ergonomic Mouse Computer Input Device*; Proceedings of the Human Factors and Ergonomics Society 39th Annual Meeting—1995; pp. 369-373.
Donald A Dennis; *Become an Industrial Athlete*: Ergonomic Don's Guide to Preventing Office Injuries; May/Jun. 2000, Law Practice Management; pp. 47-48.
T. Zeh; *The Technology of Ergonomic Touch Entry Devices*; IEE 1999; pp. 343-345.

* cited by examiner

*Primary Examiner*—Amr A. Awad
*Assistant Examiner*—Tom Sheng
(74) *Attorney, Agent, or Firm*—Merchant & Gould P.C.; Mark R. Hennings

(57) ABSTRACT

An ergonomic pointing device receives commands from a user for controlling an electronic device. The ergonomic pointing device generally comprises a shaft, a roller, and a frame. The shaft comprises a ground spring contact and two direction-sensing spring contacts. The roller is disposed around the shaft so that the roller is free to rotate about the longitudinal axis of the shaft. The inside of the roller comprises a conductive surface that is arranged to remain in electrical contact with the ground spring contact of the shaft throughout the entire revolution of the roller. The conductive surface is also arranged to alternately make and break electrical contact with the direction-sensing spring contacts during an entire revolution of the roller such that the direction and speed of the revolution of the roller can be determined. The shaft is free to move along the Z-axis but not to rotate about its longitudinal axis.

24 Claims, 5 Drawing Sheets

ERGONOMIC POINTING DEVICE

BACKGROUND OF THE INVENTION

Small, mobile devices such as hand-held and pocket-sized computers, tablet computers, cellular telephones and the like, are becoming important and popular tools. In general, they have become small enough to be extremely convenient, while consuming less battery power, and at the same time have become capable of running more powerful applications.

Pointing devices for entering commands into such mobile devices are currently available in a variety of configurations. Mechanical encoder wheels are often used in various mobile devices as part of the user interface. Many such mechanical encoder wheels include a rotatable wheel or roller mounted on the device. As the wheel is moved, transducers sense the movement of the wheel and generate signals that indicate the direction and amount of the movement. The signals are used, for example, to control movement of a cursor on the screen of the mobile device. The signals may also be used, for example, for scrolling a window that is displayed on the screen in a way that is similar to using the scroll bar of a window to scroll the window.

The shrinking size of mobile devices often entails using smaller pointing devices. However, the smaller features of the smaller input devices commonly result in increased manufacturing difficulties and reliability problems (including increased wear). Manufacturing difficulties typically result in increased cost of manufacturing the mobile devices that comprise the smaller pointing devices. Reliability problems may result in intermittent functionality of the wheel such that, for example, the scrollable window may appear to jump or the wheel may appear to move discontinuously. In more extreme cases, the wheel could fail entirely, which can render the mobile device unusable and require expensive replacement or repair.

SUMMARY OF THE INVENTION

Briefly stated, the present invention is directed towards an ergonomic pointing device for receiving commands from a user for controlling an electronic device. The ergonomic pointing device may be configured as a mechanical encoder wheel. The encoder wheel generally comprises a shaft, a roller, and a frame. The shaft comprises a ground spring contact and two direction-sensing spring contacts. The roller is disposed around the shaft so that the roller is free to rotate about the longitudinal axis of the shaft. The inside of the roller comprises a conductive surface that is arranged to remain in electrical contact with the ground spring contact of the shaft throughout the entire revolution of the roller. The conductive surface is also arranged to alternately make and break electrical contact with the direction-sensing spring contacts during an entire revolution of the roller such that the direction and speed of the revolution of the roller can be determined. The frame is arranged to captivate the shaft such that the shaft is free to move for limited distance along the Z-axis but not to rotate about its longitudinal axis.

According to one aspect of the invention a pointing device for controlling an electronic device comprises a wheel, a captivated shaft, and a frame. The wheel is arranged to provide a region of nonconductivity within a conductive inner surface of the wheel such that the region of nonconductivity orbits about the axis of rotation of the wheel in conjunction with rotation of the wheel. The captivated shaft is arranged within the wheel along the axis of rotation of the wheel and comprises switch contacts that are arranged to make and break contact with the conductive inner surface of the wheel in response to the region of nonconductivity orbiting about the captivated shaft. The frame is arranged to captivate the captivated shaft such that the captivated shaft is prevented from rotating in conjunction with the rotation of the wheel.

According to another aspect of the invention, an electronic device comprises a wheel, a captivated shaft, a frame, and a processor. The wheel is arranged to provide a region of nonconductivity within a conductive inner surface of the wheel such that the region of nonconductivity orbits about the axis of rotation of the wheel in conjunction with rotation of the wheel. The captivated shaft is arranged within the wheel along the axis of rotation of the wheel and comprises switch contacts that are arranged to make and break contact with the conductive inner surface of the wheel in response to the region of nonconductivity orbiting about the captivated shaft. The frame is arranged to captivate the captivated shaft such that the captivated shaft is prevented from rotating in conjunction with the rotation of the wheel. The processor is arranged to receive electrical signals from the switch contacts.

An appreciation of the present invention and its improvements can be obtained by reference to the accompanying drawings, which are briefly summarized below, to the following detailed description of illustrated embodiments of the invention, and to the appended claims.

DETAILED DESCRIPTION OF THE INVENTION

Figure 1:
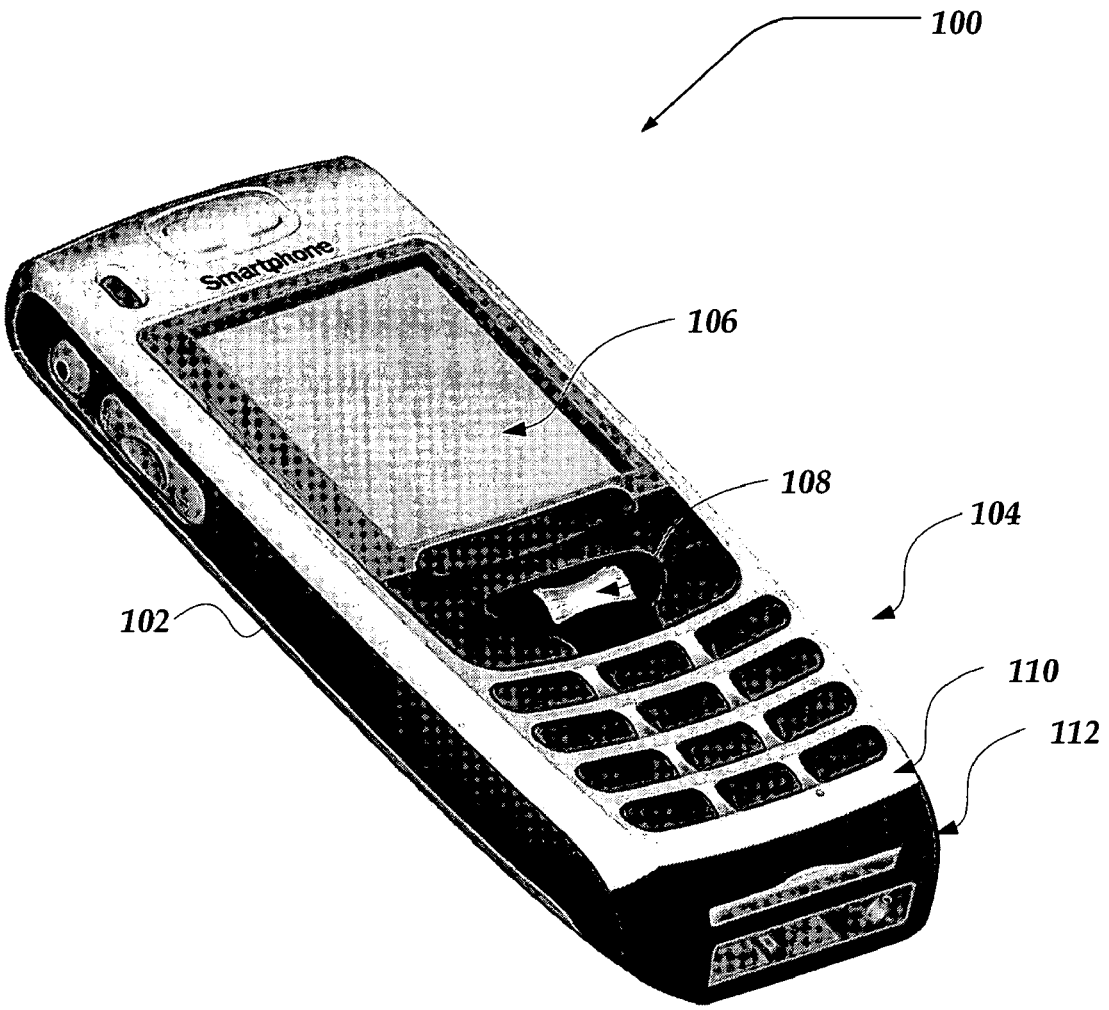
FIG. 1 illustrates an exemplary mobile device in accordance with the present invention.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

Briefly stated, the present invention is directed towards an ergonomic pointing device for receiving commands from a user for controlling an electronic device. The ergonomic pointing device may be configured as a mechanical encoder wheel. The encoder wheel generally comprises a shaft, a roller, and a frame. The shaft comprises a ground spring contact and two direction-sensing spring contacts. The roller is disposed around the shaft so that the roller is free to rotate about the longitudinal axis of the shaft. The inside of the roller comprises a conductive surface that is arranged to remain in electrical contact with the ground spring contact of the shaft throughout the entire revolution of the roller. The conductive surface is also arranged to alternately make and break electrical contact with the direction-sensing spring contacts during an entire revolution of the roller such that the direction and speed of the revolution of the roller can be determined. The frame is arranged to captivate the shaft such that the shaft is free to move for limited distance along the Z-axis but not to rotate about its longitudinal axis.

FIG. 1 illustrates an exemplary mobile device in accordance with the present invention. Mobile device 100 may include many more or less components than those shown. The components shown, however, are sufficient to disclose an illustrative embodiment for practicing the invention. Mobile device 100 includes case 102. Case 102 typically is arranged to support and protect user interface instrumentalities such as keypad 104 and display 106. Keypad 104 is often programmable and can be used for functions such as text input, game functions, phone dialing, and the like. Display 106 may optionally contain a touch screen interface, which can also be used for input of text. Display 106 may be used to display maps, text, games, pictures, and the like. Wheel 108 may be used in conjunction with Display 106 to enable manipulation and selection of displayed information by a user. Fascia 110 typically overlies keypad 104 and display 106 and can be used to display legends for buttons, brand names, and the like. Boot 112 can be extended outwards from case 102, which can be used to release keypad 104 and fascia 110 for replacement. Keypad 104 and fascia 110 can be customized for different applications such as game playing, text entry, phone dialing, and the like.

Generally, mobile device 100 may include virtually any portable computing device capable of receiving and transmitting signals between another mobile device, and providing audio signals, such as ringer tones, and the like. Such devices include cellular telephones, smart phones, audio pagers, radio frequency (RF) devices, infrared (IR) devices, integrated devices combining one or more of the preceding devices, and the like. Mobile device 100 may also include other devices, such as Personal Digital Assistants (PDA) with audio functions, handheld computers, wearable computers, and the like. As such, mobile device 100 typically ranges widely in terms of capabilities and features.

Figure 2:
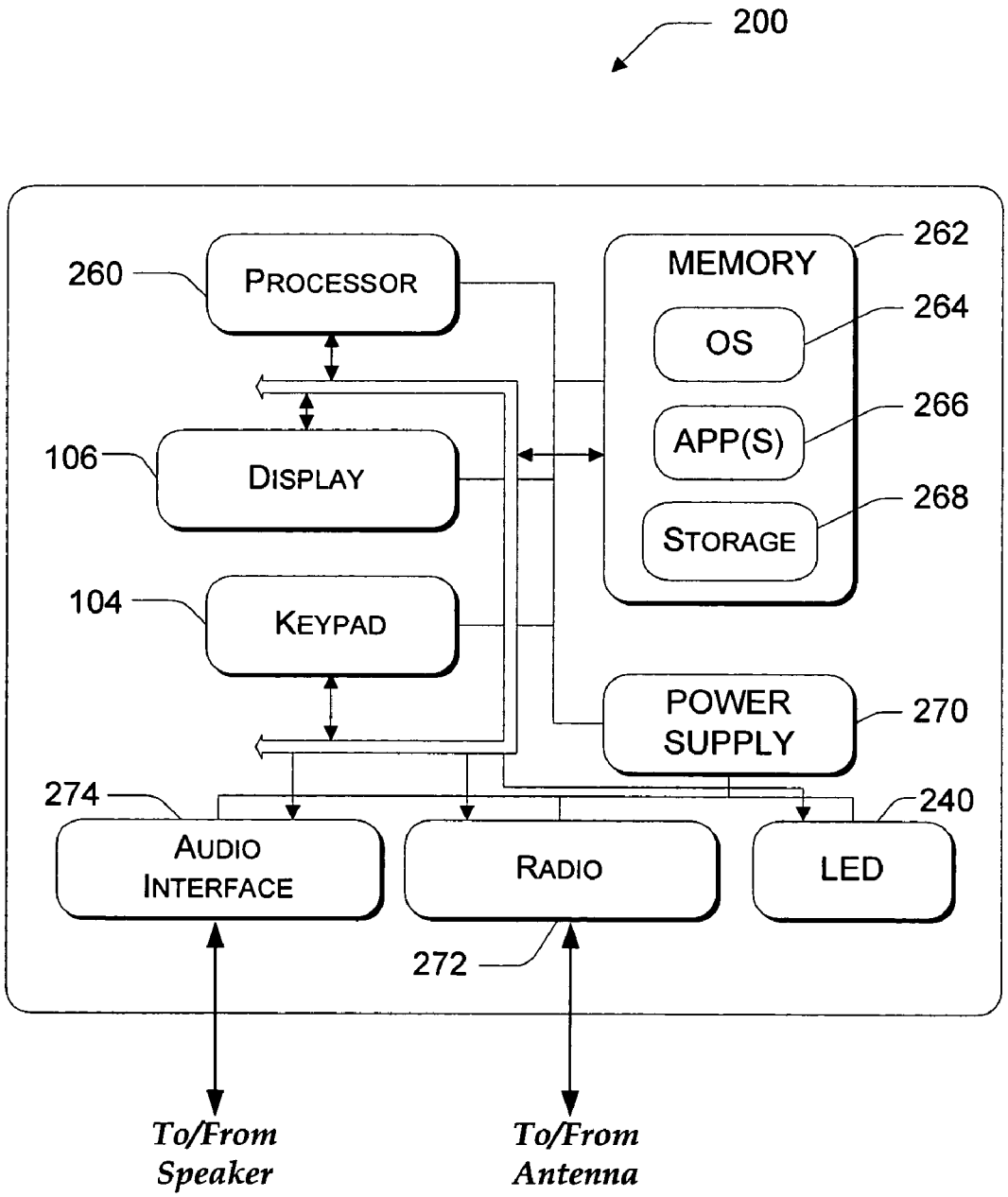
FIG. 2 is a functional block diagram illustrating an embodiment of functional components of an example mobile device in accordance with the present invention.

FIG. 2 is a functional block diagram illustrating an embodiment of functional components of an example mobile device in accordance with the present invention. Components 200 may include many more or less components than those shown. The components shown, however, are sufficient to disclose an illustrative embodiment for practicing the invention.

As shown in the figure, components 200 include processor 260, memory 262, display 106, and keypad 104. Memory 262 generally includes both volatile memory (e.g., RAM) and non-volatile memory (e.g., ROM, Flash Memory, or the like). Components 200 may include an operating system 264, such as the Windows CE operating system from Microsoft Corporation or other such operating system, which is resident in memory 262 and executes on processor 260. Keypad 104 may be a push button numeric dialing pad (such as on a typical telephone), a game pad, or the like. Display 106 may be a liquid crystal display, or any other type of display commonly used in a mobile communications device. For example, display 106 may be touch-sensitive, and would then also act as an input device.

One or more application programs 266 may be loaded into memory 262 and run on operating system 264. Examples of application programs include phone dialer programs, email programs, user ringer tone selection programs, and so forth. The application programs may operate in conjunction with wheel 108 to, for example, allow a user to select a particular data field displayed in a list. Components 200 also include non-volatile storage 268 within memory 262. Non-volatile storage 268 may be used to store persistent information which should not be lost if the mobile device 100 is powered down. The application programs 266 may use and store information in storage 268, such as e-mail, user selectable ringer tones, and the like.

Components 200 also include power supply 270, which may be implemented as one or more batteries. Power supply 270 might further include an external power source, such as an AC adapter or a powered docking cradle that supplements or recharges the batteries.

Components 200 are also shown with two types of external notification mechanisms: LED 240 and audio interface 274. These devices may be directly coupled to power supply 270 so that when activated, they remain on for a duration dictated by the notification mechanism even though processor 260 and other components might shut down to conserve battery power. LED 240 may be programmed to remain on indefinitely until the user takes action to indicate the powered-on status of the device. Audio interface 274 is used to provide audible signals to and receive audible signals from the user. For example, audio interface 274 may be coupled to a speaker for providing audible output. The audible output may be provided in response to an input command such as a button press or manipulation of wheel 108. Audio interface 274 may also be coupled to a microphone, receiving speaker, or the like, for receiving audible input, such as to facilitate a telephone conversation.

Components 200 also include radio 272 that performs the function of transmitting and receiving radio frequency communications. Radio 272 may be coupled to an antenna. Radio 272 facilitates wireless connectivity between components 200 and the outside world, via a communications carrier or service provider. Transmissions to and from radio 272 are conducted under the control of operating system 264 such that communications received by radio 272 may be disseminated to application programs 266 via operating system 264, and vice versa.

Radio 272 allows components 200 to communicate with other computing devices, such as over a network. Radio 272 is one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Figure 3:
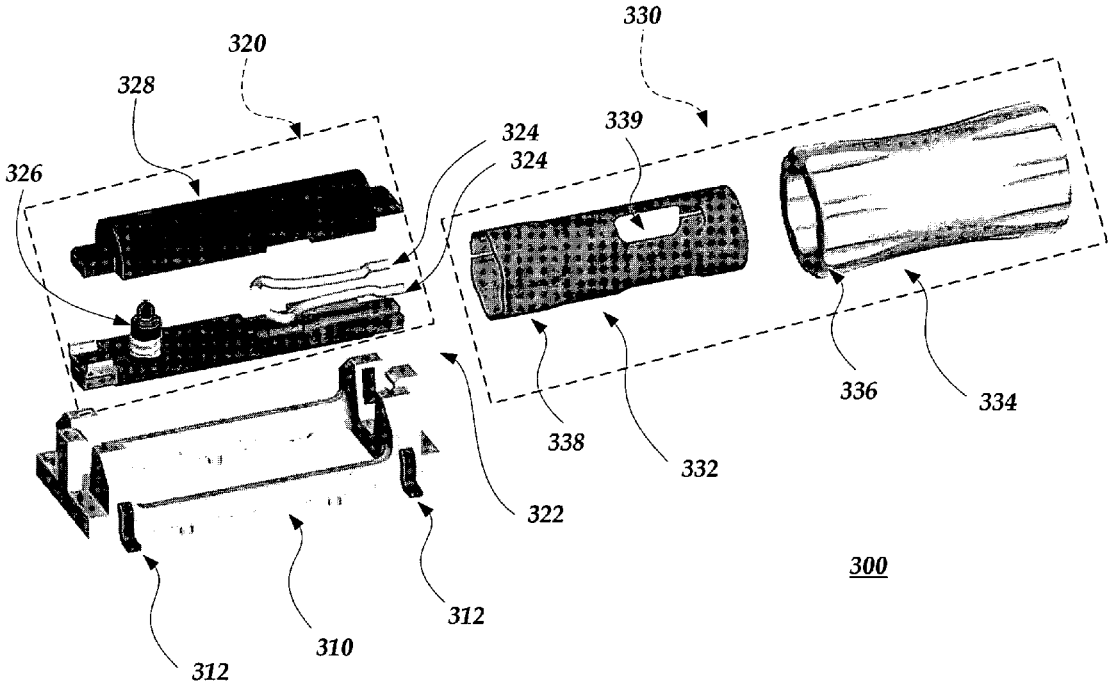
FIG. 3 is an exploded-view diagram generally illustrating components of a wheel assembly in accordance with the present invention.

FIG. 3 is an exploded-view diagram generally illustrating components of a wheel assembly in accordance with the present invention. Illustrated in wheel assembly 300 are frame 310, shaft 320, and roller 330.

Shaft 320 comprises shaft base 322, direction-sensing spring contacts 324, and ground spring contact 326. Shaft 320 also comprises optional shaft cover 328. Shaft cover 328 is typically provided to help secure shaft components such as contacts 324 and 326. Shaft 320 is arranged to allow roller 330 to rotate in a forwards and backwards direction about the longitudinal axis of shaft 320.

Frame 310 is arranged to captivate shaft 320 (about which roller 330 is disposed) such that shaft 320 is free to move for a short distance in a direction (e.g., up or down along the Z-axis) that is substantially perpendicular to the axis of rotation of roller 330. Shaft 320 is also typically captivated in a manner that prevents shaft 320 from rotating in conjunction with roller 330. Frame 310 may also comprise electrical contacts 312 for providing electrical connections to direction-sensing spring contacts 324 and ground spring contact 326.

Direction-sensing spring contacts 324 are arranged within shaft 320 such that contacts (324) alternately make and break electrical contact with roller 330 during an entire revolution of roller 330. Direction-sensing spring contacts 324 are typically aligned lengthwise along the axis of rotation.

Ground spring contact 326 is arranged within shaft 320 such that contact 326 remains electrically coupled to roller 330 throughout an entire revolution of roller 330. Direction-sensing spring contacts 324 and ground spring contact 326 are arranged as switches for indicating the rotational speed and direction of rotation of roller 330. In other embodiments, ground spring contact 330 may also be arranged to make and break contact in response to the rotation of roller 330 as long as the rotational speed and direction of rotation of roller 330 can still be determined.

In one embodiment, roller 330 comprises an electrically conductive contact sleeve 332 and roller casing 334. Contact sleeve 332 is rigidly affixed within roller casing 334 so that contact sleeve 332 and wheel casing 334 rotate (and move in a direction that is substantially perpendicular to the axis of rotation) as a unit. Internal knurls 338 may be used to rigidly secure sleeve 332 and casing 334 as a unit. Contact sleeve 332 optionally comprises knurls 338 that are arranged to provide detent positions about the axis of rotation. Internal knurls 338 may operate in conjunction with ground spring contact 340 to provide the detent positions.

Contact sleeve 332 comprises one or more regions of nonconductivity 339. Regions of nonconductivity 339 are typically embodied as apertures within contact sleeve 332, although coatings or depressions within sleeve 332 may also be employed. Regions 339 and contacts 324 are arranged to provide switching such that an electrical circuit can determine the direction and speed of rotation of roller 330. Regions 339 and/or contacts 324 are typically circumferentially arranged about the axis of rotation at an angle of other than 180 degrees to enable the detection by the electrical circuit of the direction of rotation of roller 330.

In other embodiments, roller 330 may be formed as an integral unit that has one or more regions of nonconductivitiy that are arranged to open and close at least one electrical circuit during the rotation of roller 330. In various embodiments, roller 330 may comprise external knurls 336, which typically help a user to more easily manipulate the roller.

Figure 4A:
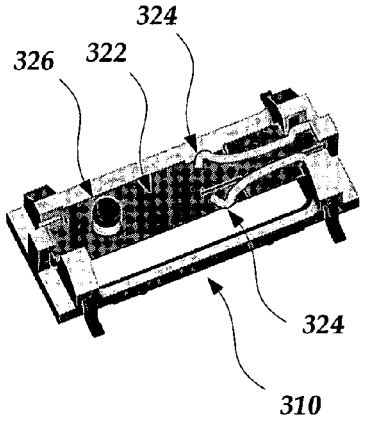
FIG. 4*a* is a view diagram generally illustrating components of a partially assembled shaft in accordance with the present invention.

FIG. 4*a* is a view diagram generally illustrating components of a partially assembled shaft in accordance with the present invention. Shaft base 322 is inserted into and captivated by vertical channels at opposing ends of frame 310. Direction-sensing spring contacts 330 and ground spring contact 340 are illustrated as being affixed to shaft base 322.

Figure 4B:
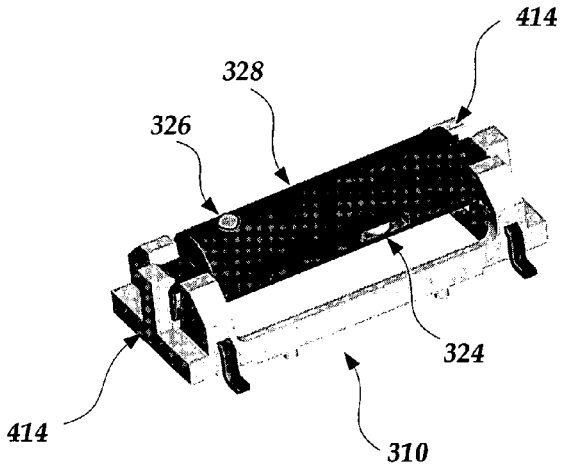
FIG. 4*b* is a view diagram generally illustrating a shaft that is captivated by a frame in accordance with the present invention.

FIG. 4*b* is a view diagram generally illustrating a shaft that is captivated by a frame in accordance with the present invention. Shaft cover 328 is shown as being mounted upon the shaft base 322. Direction-sensing spring contacts 330 and ground spring contact 340 are shown as partially extending beyond the outer diameter of shaft base 322 and shaft cover 328. Frame 310 is shown as having retaining locking clips 414 that are configured to captivate shaft 320 such that shaft 320 is free to move for a short distance in an upwards or downwards direction. Flexing locking clips 414 in a direction generally outwards from shaft base 322 and shaft cover 328 allows the shaft to be inserted or removed.

Figure 4C:
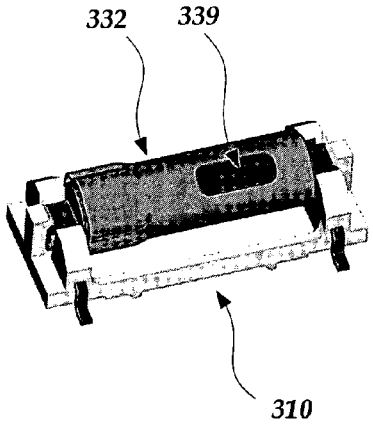
FIG. 4*c* is a view diagram generally illustrating a shaft sleeve disposed around shaft in accordance with the present invention.

FIG. 4*c* is a view diagram generally illustrating a shaft sleeve disposed around shaft in accordance with the present invention A portion of shaft 328 is visible within region 339 of shaft sleeve 332. As shaft sleeve 332 rotates around shaft 322, direction-sensing contacts 324 alternately make and break contact with the conductive shaft sleeve (332) because the orbital path of the void within region 239 includes the locations of the contacting portions of contacts 324.

Figure 4D:
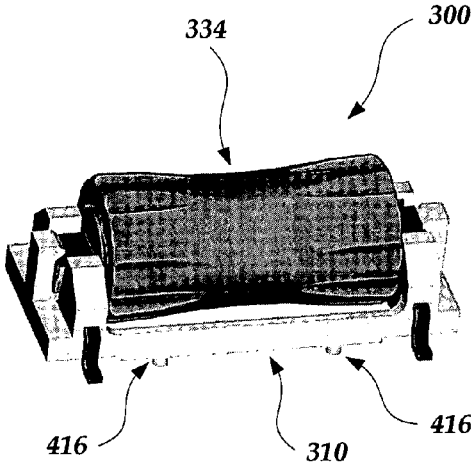
FIG. 4*d* is a view diagram generally illustrating a fully assembled wheel assembly in accordance with the present invention.

FIG. 4*d* is a view diagram generally illustrating a fully assembled wheel assembly in accordance with the present invention. Wheel cover 334 is disposed around sleeve cover 332. Frame 310 comprises tabs 416 that are suitable to align wheel assembly 300 for mounting the assembly (300) on a substrate such as a printed circuit board. Tabs 416 also provide strain relief (after mounting) against forces directed parallel to the surface of the mounting substrate.

Figure 5:
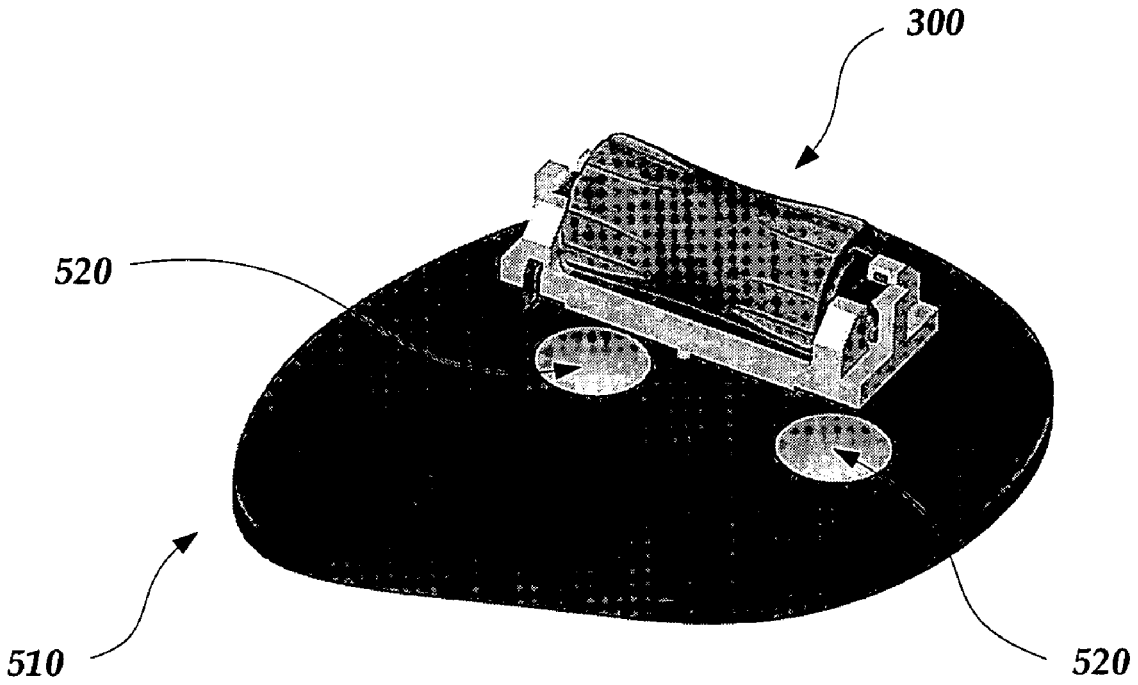
FIG. 5 is a view diagram illustrating a fully assembled wheel and a mounting substrate in accordance with the present invention.

FIG. 5 is a view diagram illustrating a fully assembled wheel and a mounting substrate in accordance with the present invention. Mounting substrate 510 comprises switches 520 that are disposed underneath and at opposite ends of wheel assembly 300. Wheel assembly 300 can be mounted on substrate 510 such that a downwards force exerted upon wheel 330 causes at least one of the switches to be actuated.

As discussed above, shaft 320 is captivated by frame 310 such that each end of shaft 320 is relatively free to move independently in an upwards or downwards directions (i.e., along the Z-axis). A downwards force imparted to a central area closes both switches 520. A downwards force imparted above the longitudinal axis but offset to the left or right of the central area closes a single switch 520 that is proximate to the location of imparted force to wheel 330.

Springs (not shown) may be used to return the depressed wheel to its original position. The springs may be located within switches 520, mounted on substrate 510, within wheel assembly 300, or in any other suitable location. The springs may also be used as electrical contacts (e.g., as in ground spring contact 326 or electrical contacts 312) to electrically couple with, for example, at least one direction-sensing contact 324.

Other embodiments of the invention are possible without departing from the spirit and scope of the invention. For example, the wheel may be mounted in a "mouse" and electrically coupled to a processor via an external cable. The above specification, examples, and data provide a complete description of the manufacture and use of the composition of the invention. Since many embodiments of the invention can be made without departing from the spirit and scope of the invention, the invention resides in the claims hereinafter appended.

I claim:

1. A pointing device for controlling an electronic device, comprising:

a wheel that is arranged to provide a region of nonconductivity within a conductive inner surface of the wheel such that the region of nonconductivity orbits about the axis of rotation of the wheel in conjunction with rotation of the wheel;

a captivated shaft that is arranged within the wheel along the axis of rotation of the wheel and comprises switch contacts that are arranged to make and break contact with the conductive inner surface of the wheel in response to the region of nonconductivity orbiting about the captivated shaft; and a frame that is arranged to captivate the captivated shaft such that the captivated shaft is prevented from rotating in conjunction with the rotation of the wheel.

2. The pointing device of claim 1, wherein the frame is further arranged to captivate the captivated shaft such that the captivated shaft is free to move in a direction that is substantially perpendicular to the axis of rotation of the wheel.

3. The pointing device of claim 1, wherein the wheel is further arranged to provide a second region of nonconductivity within a conductive inner surface of the wheel such that the second region of nonconductivity orbits about the axis of rotation of the wheel in conjunction with rotation of the wheel, and wherein the switch contacts of the captivated shaft are further arranged to make and break contact with the conductive inner surface of the wheel in response to the second region of nonconductivity orbiting about the captivated shaft.

4. The pointing device of claim 1, wherein the captivated shaft is further arranged to provide a ground contact that is arranged to maintain electrical contact with the conductive inner surface of the wheel during a complete revolution of the wheel.

5. The pointing device of claim 4, wherein the conductive inner surface of the wheel and the ground contact are arranged to provide detent positions during rotation of the wheel.

6. The pointing device of claim 1, wherein the outer surface of the wheel comprises a plastic material.

7. The pointing device of claim 6, wherein the inner surface of the wheel is a metal sleeve and the first region of nonconductivity is a void within the metal sleeve.

8. The pointing device of claim 1, wherein the frame is further arranged to mount on a substrate of an electrical circuit.

9. The pointing device of claim 1, wherein the frame is further arranged to captivate the captivated shaft such that the captivated shaft is free to move in a direction that is substantially perpendicular to the axis of rotation of the wheel, and wherein the substrate of the electrical circuit comprises switches that are configured to make and break contact in response to movement of the wheel in the direction that is substantially perpendicular to the axis of rotation of the wheel.

10. The pointing device of claim 9, further comprising a spring that is configured to impart a force to the wheel in a direction that is away from and substantially perpendicular to the axis of rotation of the wheel and is further configured to electrically couple with at least one switch contact of the captivated shaft.

11. The pointing device of claim 9, further comprising a spring means for imparting a force to the wheel means in a direction that is away from and substantially perpendicular to the axis of rotation of the wheel means and for electrically coupling with the switch contact means of the shaft means.

12. A pointing device for controlling an electronic device, comprising:

a wheel means for providing a region of nonconductivity within a conductive inner surface of the wheel means such that the region of nonconductivity orbits about the axis of rotation of the wheel means in conjunction with rotation of the wheel means;

a shaft means arranged within the wheel means along the axis of rotation of the wheel means and comprises switch contact means for making and breaking contact with the conductive inner surface of the wheel in response to the region of nonconductivity orbiting about the shaft means; and a frame means that is arranged to captivate the shaft means such that the shaft means is prevented from rotating in conjunction with the rotation of the wheel means.

13. The pointing device of claim 12, wherein the frame means is further arranged to captivate the shaft means such that the shaft means is free to move in a direction that is substantially perpendicular to the axis of rotation of the wheel means.

14. The pointing device of claim 12, wherein the wheel means further provides a second region of nonconductivity within a conductive inner surface of the wheel means such that the second region of nonconductivity orbits about the axis of rotation of the wheel means in conjunction with rotation of the wheel means, and wherein the switch contact means of the shaft means further makes and breaks contact with the conductive inner surface of the wheel means in response to the second region of nonconductivity orbiting about the shaft means.

15. The pointing device of claim 12, wherein the shaft means further to provides a ground contact means for maintaining electrical contact with the conductive inner surface of the wheel means during a complete revolution of the wheel means.

16. The pointing device of claim 15, wherein the conductive inner surface of the wheel means and the ground contact means provide detent positions during rotation of the wheel means.

17. The pointing device of claim 12, wherein the outer surface of the wheel means comprises a plastic material.

18. The pointing device of claim 17, wherein the inner surface of the wheel means is a metal sleeve and the first region of nonconductivity is a void within the metal sleeve.

19. The pointing device of claim 12, wherein the frame means further is mounted on a substrate of an electrical circuit.

20. The pointing device of claim 12, wherein the frame means captivates the shaft means such that the shaft means is free to move in a direction that is substantially perpendicular to the axis of rotation of the wheel means, and wherein the substrate of the electrical circuit comprises switches that are configured to make and break contact in response to movement of the wheel means in the direction that is substantially perpendicular to the axis of rotation of the wheel means.

21. An electronic device, comprising:

a wheel that is arranged to provide a region of nonconductivity within a conductive inner surface of the wheel such that the region of nonconductivity orbits about the axis of rotation of the wheel in conjunction with rotation of the wheel;

a captivated shaft that is arranged within the wheel along the axis of rotation of the wheel and comprises switch contacts that are arranged to make and break contact with the conductive inner surface of the wheel in response to the region of nonconductivity orbiting about the captivated shaft;

a frame that is arranged to captivate the captivated shaft such that the captivated shaft is prevented from rotating in conjunction with the rotation of the wheel; and a processor that is arranged to receive electrical signals from the switch contacts.

22. The device of claim 21, wherein the processor is further arranged to change a displayed image in response to the received electrical signals.

23. The device of claim 22, further comprising a display that is arranged to display the displayed image.

24. The device of claim 21, further comprising an application program that is configured to select a particular data field displayed in a list in response to the received electrical signals.

* * * * *